United States Patent [19]

Alexander

[11] 4,069,519

[45] Jan. 24, 1978

[54] BIDET

[76] Inventor: Dale W. Alexander, 324 Royal Palm Way, Palm Beach, Fla. 33480

[21] Appl. No.: 760,925

[22] Filed: Jan. 21, 1977

[51] Int. Cl.[2] ..... A47K 7/08
[52] U.S. Cl. ..... 4/7
[58] Field of Search ..... 4/6, 7

[56] References Cited

U.S. PATENT DOCUMENTS

| | | | |
|---|---|---|---|
| 1,346,252 | 7/1920 | Rathbone | 4/7 |
| 1,521,892 | 1/1925 | Koppin | 4/7 |
| 1,872,278 | 8/1932 | Guidetti et al. | 4/7 |
| 1,962,014 | 6/1934 | Guidetti | 4/7 |
| 1,988,078 | 1/1935 | Guidetti | 4/7 |
| 2,104,271 | 1/1938 | Parisini | 4/7 |
| 2,278,055 | 3/1942 | Bigio | 4/7 |
| 3,605,124 | 9/1971 | Marcard et al. | 4/7 |

FOREIGN PATENT DOCUMENTS

| | | | |
|---|---|---|---|
| 1,955,075 | 5/1971 | Germany | 4/7 |

*Primary Examiner*—Richard E. Aegerter
*Assistant Examiner*—Richard R. Stearns
*Attorney, Agent, or Firm*—D. Paul Weaver

[57] ABSTRACT

A sanitary cleansing device or bidet is attached by only two screws to the bottom of a toilet seat whereby horizontal movement of a control handle causes a spray nozzle arm of the device to move in a compound arc between positions of use below and at the center of the toilet seat and non-use under the rear portion of the seat in a level position between seat and toilet bowl. The device features a living hinge between its rotational body and spray nozzle arm and an eccentric flex link which imparts motion to the spray nozzle arm by a combined bending and push-pull action. Cleansing fluid is supplied through a handle mounted valve.

10 Claims, 10 Drawing Figures

FIG.1
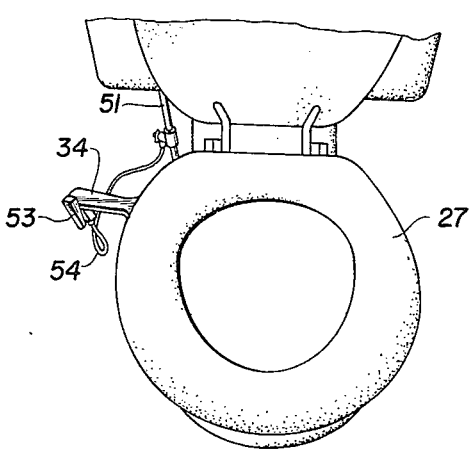
FIG.2
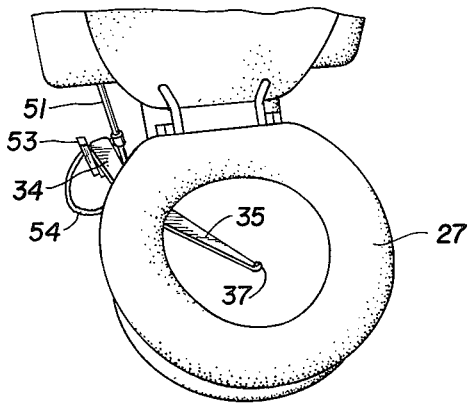
FIG.3
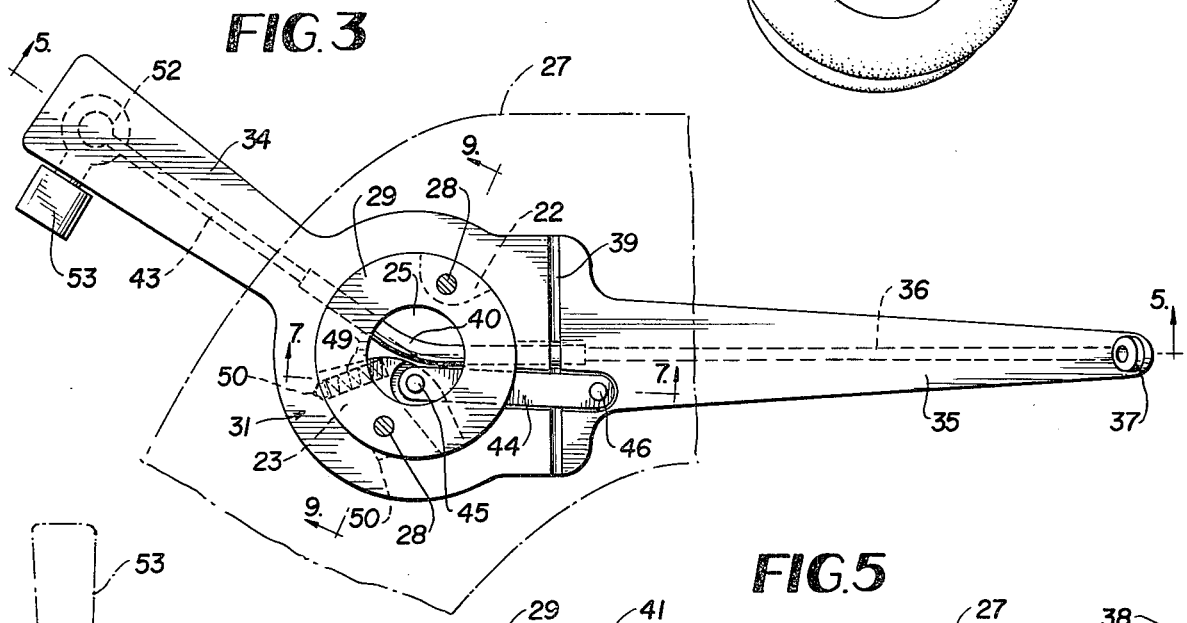
FIG.5
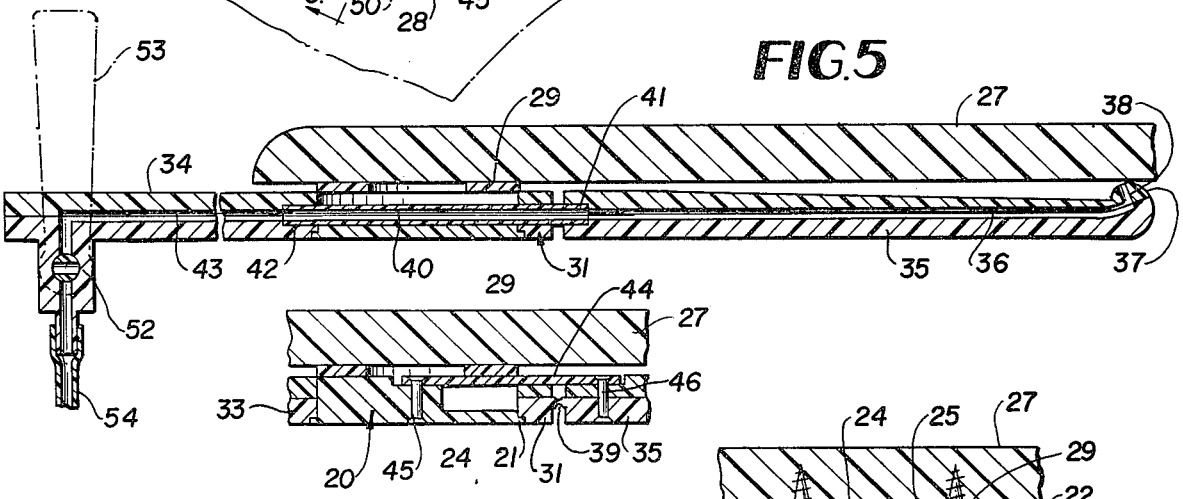
FIG.7
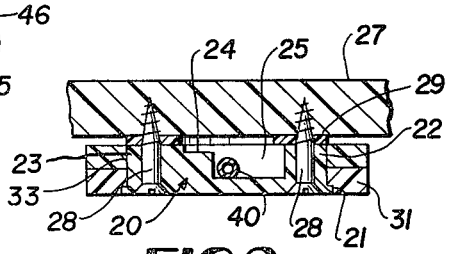
FIG.9

BIDET

BACKGROUND OF THE INVENTION

Sanitary cleansing devices associated with toilets, sometimes called bidets, are well known and some examples of the patented prior art are U.S. Pat. Nos. 1,866,930; 2,104,271; 1,949,415; 1,962,014 and 1,872,278.

Such prior art devices have not been widely adopted commercially in this country because their usage in most cases requires modification of standard plumbing fixtures to a greater extent than is deemed feasible by manufacturers. This is because the prior art devices tend to be bulky and awkward and complicated and costly to manufacture.

It is therefore the object of the invention to obviate these deficiencies of the prior art through provision of an extremely simplified and low cost sanitary cleansing device or bidet which is compact and which can be mounted to the underside of a toilet seat with only two screws in a very secure manner. Furthermore, the invention is shiftable by the user between active and stored positions by the mere swinging of a handle through a short horizontal stroke near one side of the seat, a uniquely simplified operational linkage causing the spray nozzle arm to then swing through a compound movement arc between a seat centered depressed use position and a retracted level position beneath the rear of the toilet seat and between the seat and bowl rim. Except for the two seat mounting screws, no modification of the standard plumbing fixture is required for the installation of the invention.

Summary of the Invention

A circular mounting disc attaches directly by means of two screws to the bottom of a toilet seat near the rear thereof. The disc rotatably mounts a ring-like body having a handle extension and an elongated spray nozzle arm hinged to said body preferably by an integral or living hinge. An eccentrically mounted push-pull flex link interconnects the disc and said spray nozzle arm, whereby rotational movement of the ring-like body in a horizontal plane by use of the handle swings the spray nozzle arm through a compound arc of movement between an elevated level position beneath the back of the toilet seat and a depressed use position below and centrally of the seat. Passage means for fluid are provided in the handle, disc and spray nozzle arms including flexible conduit means. The control handle is equipped with an on-off valve for fluid from a regular plumbing pipe or from a separate source of fluid which may be heated and/or provided with an antiseptic additive or odorant.

Brief Description of the Drawings

FIG. 1 is a fragmentary perspective view of a toilet equipped with the invention, and the invention being shown in a retracted position of non-use.

FIG. 2 is a similar view of the same toilet showing the invention shifted to its use position.

FIG. 3 is a plan view of the invention, as shown in FIG. 1.

FIG. 5 is a longitudinal vertical section taken on line 5—5 of FIG. 3.

FIG. 7 is a fragmentary vertical section taken on line 7—7 of FIG. 3.

FIG. 9 is a vertical section taken on line 9—9 of FIG. 3.

Detailed Description

Figures 4, 6, 8, 10:
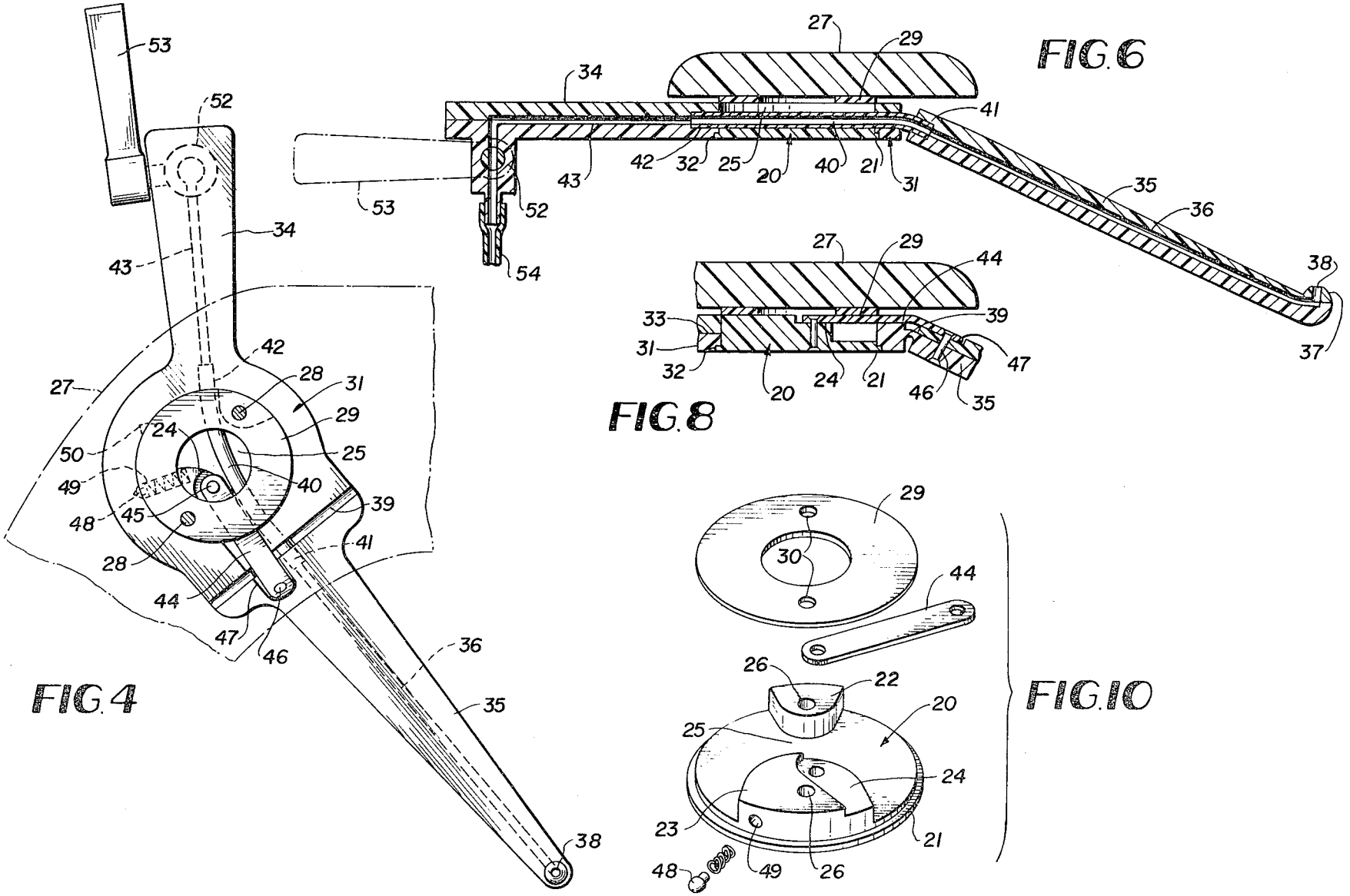
FIG. 4 is a plan view of the invention, as shown in FIG. 2.
FIG. 6 is a similar section showing the invention in the use position of FIG. 2.
FIG. 8 is a similar section showing the flexed position of a hinge and associated link.
FIG. 10 is an exploded perspective view of the mounting disc and associated parts.

Referring to the drawings in detail, the numeral 20 designates a disc formed of plastics material or the like and being circular in formation with a lower marginal flange 21 thereon and a pair of top mounting bosses 22 and 23, the boss 23 having a stepped recess 24, for a purpose to be described. A channel or passageway 25 for a flexible fluid conduit is provided across the top of the disc 20 between the two bosses 22 and 23. The bosses 22 and 23 have diametrically opposed openings 26 formed therethrough and extending entirely through the disc 20, and these two openings are spaced equidistantly from the center of the circular disc 20.

As shown in the cross sectional views, particularly FIG. 9, the disc 20 is secured fixedly to the lower side of a conventional toilet seat 27 with the bosses 22 and 23 facing upwardly by a single pair of screws 28 which engage upwardly through the two openings 26 and are threaded into the bottom of the seat 27. Preferably, but not necessarily, a large thin bearing washer 29 having diametrically spaced openings 30 in registration with the openings 26 is intervened between the lower surface of the seat 27 and the flat top faces of the bosses 22 and 23. The two screws 28 also extend through the openings 30 of washer 29. The disc 20 is thus fixed to the lower side of the toilet seat at one side and near the rear thereof.

The invention further includes a ring-like rotational body 31 surrounding the disc 20 and having a lower side annular recess 32 receiving the lower flange 21 of the disc. A main cylindrical bore 33 of the body 31 rotationally engages the main cylindrical portion of the stationary disc 20.

The ring-like body 31 carries an integral radial handle 34 which projects horizontally outwardly of the seat 27 for convenient grasping. This handle with the entire ring-like body 31 is swingable horizontally through a limited arc of about sixty degrees, as will be further explained.

The device further comprises an elongated tapering spray nozzle arm 35 having a longitudinal internal fluid passage 36 leading to a spray nozzle tip 37 having a nozzle bore 38 which is vertical, FIG. 6, when the arm 35 is in the depressed angular use position. When the arm 35 is in the raised level non-use position, FIG. 5, the spray nozzle bore 38 is no longer vertical but inclined.

As best shown in FIGS. 7 and 8, the arm 35 which is rigid is connected to the rotational ring body 31 through an integral or living hinge web 39 which is capable of withstanding repeated flexures without damage or failure. The living hinge is separated into two sections, FIG. 4, to provide clearance for a flexible conduit or tube 40 which has its leading end 41 connected in a fluid tight joint with the passage 36 and its rear end 42 connected in a similar manner with a fluid passage 43 extending longitudinally through the handle 34. The flexible tube 40 lies in the passageway 25 of the disc 20 and can bend to accommodate the angular movement of the arm 35 while accommodating itself within the passage 25 during rotation of the ring body 31 around the disc 20.

Rotational movement of the ring body 31 by use of the handle 34 is converted into a compound arcuate movement of the arm 35 by a unique flexible push-pull link 44 of tough plastics material. The link 44 has its rear end portion seated on the stepped recess 24 of disc 20 and pivoted to the disc by a rivet 45 or the like which is eccentric to the center of the disc 20 and rotational axis of the ring body 31. The other end of the flex link 44 is connected by a rivet 46 to the base of spray nozzle arm 35 toward one side of this arm. The top of the arm 35 also has a recessed seat 47, FIG. 8, to receive the link 44. The link extends across the living hinge 39 and flexes in concert therewith during rotation of the ring body 31. The movement is such that, while the ring body 31 and handle 34 are rotating in a horizontal plane around the stationary disc 20, the arm 35 is swinging in a compound arc between the level non-use position of FIG. 5 and the depressed angular use position of FIG. 6, the two positions also being shown in FIGS. 1 and 2. The mechanical linkage arrangement for driving the arm 35 in this manner is extremely simplified and compact and very economical to manufacture. The entire device is very well adapted to be formed from plastics and may be colored to coordinate with the toilet seat or the entire plumbing fixture.

Detent means is provided to limit movement of the handle 34 and ring body 31 within proper limits. This means comprises a spring-urged detent pin 48 held in a radial passage 49 of disc 20 and being engageable with two circumferentially spaced detent recesses 50 in the bore of ring body 31. Therefore when the ring body 31 rotates within prescribed limits, the detent element 48 will snap into one or the other of recesses 50 and limit the travel.

Water from a plumbing supply pipe 51, FIGS. 1 and 2, is supplied to the invention through an on-off valve 52 which may be formed integrally on the handle 34, as shown. The valve is equipped with a convenient operating handle 53. A suitable supply line 54 serves to connect the valve 52 with the pipe 51. Other arrangements may be employed to supply fluid to the device. For example, a separate tank with heated water under gravity feed or pressure feed and with or without antiseptic additives could be utilized in lieu of a direct hook-up with the house plumbing system.

In any event, the device is very simple and compact, practical and economical to manufacture, convenient to use, durable and requires no altering of the plumbing fixture with the exception of forming two screw holes in the bottom of the toilet seat.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A bidet comprising a stationary disc adapted to be fixed to the bottom of a toilet seat, a body portion rotatably mounted on the disc for movement therearound substantially in the plane of a seat on which the disc is mounted, said body portion having a projecting handle to facilitate rotating it, a spray arm extending from the body portion and hingedly connected therewith for pivotal movement about an axis generally parallel to said plane whereby the spray arm can swing through an arc relative to the body portion while rotating therewith, fluid conduit means connected through said handle, disc and spray arm for delivering a fluid spray upwardly from the free end of said arm when the bidet is in a use position, and a flexible push-pull link connected with the spray arm outwardly of the hinge thereof and connected with said disc at a point eccentric to the centers of the disc and said body portion, in such a manner that said spray arm is rotatable between a non-use position wherein said spray arm is generally parallel to said plane, and a use position wherein said spray arm is inclined downwardly with respect to said disc.

2. A bidet as defined in claim 1, and a manual valve means connected with said handle for controlling the admission of fluid into said conduit means.

3. A bidet as defined in claim 1, and said disc having an upper passageway formed therethrough between said handle and spray arm, and said conduit means comprising a flexible fluid conduit section lying in said passageway and having one end portion coupled with said spray arm and its opposite end portion coupled with said handle.

4. A bidet as defined in claim 3, and said fluid conduit means including internal longitudinal passages in said handle and spray arm.

5. A bidet as defined in claim 1, and the hinge connection between said spray arm and body portion is formed by a flex hinge web integrally connected with the spray arm and said body portion.

6. A bidet as defined in claim 1, and said body portion comprising a ring-like member surrounding said disc, and said handle extending radially of the ring-like member and being integral therewith, said spray arm also extending radially of the ring-like member on a side portion thereof away from said handle.

7. A bidet as defined in claim 6, and said disc having a lower side marginal flange, and said ring-like member having a recess supportively rotationally engaging said flange.

8. A bidet as defined in claim 1, and said flexible push-pull link being connected to said disc by a pivot element parallel to the rotational axis of said body portion.

9. A bidet as defined in claim 8, and said pivot element comprising a rivet.

10. A bidet as defined in claim 1, and an upturned nozzle tip on the free end of said spray arm having a spray orifice which is substantially vertical when the spray arm is in said use position.

* * * * *